US005669428A

United States Patent [19]

Hoover

[11] Patent Number: 5,669,428

[45] Date of Patent: Sep. 23, 1997

[54] CONVEYOR SYSTEM FOR LOG DEBARKING AND CHIPPING

[75] Inventor: Larry Hoover, Wadley, Ga.

[73] Assignee: Fulghum Industries, Inc., Wadley, Ga.

[21] Appl. No.: 735,492

[22] Filed: Oct. 23, 1996

Related U.S. Application Data

[63] Continuation of Ser. No. 380,988, Jan. 31, 1995, abandoned, which is a continuation-in-part of Ser. No. 303,870, Sep. 9, 1994, abandoned.

[51] Int. Cl.[6] ..... B27B 31/00; B27L 1/00

[52] U.S. Cl. ..... 144/245.2; 144/3.1; 144/208.9; 144/250.17; 144/341; 144/356; 144/367; 198/463.3; 198/592

[58] Field of Search ..... 144/3.1, 208.1, 144/208.9, 242.1, 245.2, 250.17, 340, 341, 367, 356, 357; 198/463.3, 469, 592

[56] References Cited

U.S. PATENT DOCUMENTS

| | | | |
|---|---|---|---|
| 3,457,975 | 7/1969 | Wehr . | |
| 3,807,470 | 4/1974 | Young . | |
| 4,105,107 | 8/1978 | Ekholm | 198/358 |
| 4,362,195 | 12/1982 | Hill . | |
| 4,374,533 | 2/1983 | Svensson . | |
| 4,774,987 | 10/1988 | Sepling . | |
| 5,044,412 | 9/1991 | Price et al. . | |
| 5,193,597 | 3/1993 | Strong | 144/3 R |
| 5,241,999 | 9/1993 | Fulghum, Sr. et al. | 244/208 B |
| 5,337,811 | 8/1994 | Fulghum . | |

*Primary Examiner*—W. Donald Bray

*Attorney, Agent, or Firm*—Cushman Darby & Cushman, Intellectual Property Group of Pillsbury Madison & Sutro, LLP

[57] ABSTRACT

The present invention relates to a conveyor system for log debarking and chipping. Specifically, a conveyor system for log debarking and chipping is provided that, in accordance with the present invention, conveys tree-length logs to and into a debarking drum and conveys debarked logs from the debarking drum to a chipper for chipping the debarked logs. The present invention provides a system adapted for long life, low maintenance and is adapted to withstand high impact loading while permitting high volume log processing.

49 Claims, 16 Drawing Sheets

CONVEYOR SYSTEM FOR LOG DEBARKING AND CHIPPING

CROSS REFERENCE TO RELATED APPLICATIONS

This is a continuation of application Ser. No. 08/380,988, filed on Jan. 31, 1995, which was abandoned upon the filing hereof, which, in turn, is a continuation in part of application Ser. No. 08/303,870 filed Sep. 9, 1994, now abandoned.

BACKGROUND OF THE INVENTION

1. Field of the Invention

The present invention relates to a conveyor system for conveying tree-length logs to and into a debarking drum, conveying debarked logs from the debarking drum and to a chipper for chipping the debarked logs.

2. Description of the Related Art

Wood chipping facilities, so-called chip mills, may be provided on location at pulp and paper mills or off site to produce wood chips from hard wood and/or pine logs for the paper making process. Chip mills receive and process large quantities of logs of varying lengths. Typically, at mills where long wood is processed, a crane is used to unload trees from trucks and transport them to storage piles. During the chipping process, the crane is used to transport logs to a debarking drum. In most conventional systems, an infeed chute is used to direct long wood or tree-length logs deposited by the crane into the debarking drum.

However, chute-type feeding methods are typically low capacity and necessarily intermittent as the crane must periodically retrieve logs to infeed. Thus, while it would be advantageous to debark and chip tree length wood so that pre-chipping processing is not necessary, the ability to debark tree-length logs has been impaired by the low capacity of chute-type long wood feeding methods, and the intermittent mode of operation necessitated by delivery limited to a single crane for feeding to a chute.

To overcome the deficiencies of some known chute-type feed systems, it has been proposed to use conveyors to transport logs to a debarking drum. While the conveyors proposed to date have been generally well received, conventional conveyor systems can require regular maintenance, and components of the system must be periodically replaced resulting in high operating costs and undesirable down time. Additionally, conventional conveyor systems are not suited for the high impact loading associated with high volume log processing.

Thus, there have been continuing efforts to design conveyor systems that are strong, long-life and low maintenance.

SUMMARY OF THE INVENTION

It is an object of the present invention to provide an apparatus for conveying wood to a debarking drum, from the debarking drum and to a chipper which overcomes the deficiencies of conventional wood processing facilities and in particular to provide a system adapted for long life, low maintenance and which is adapted to withstand high impact loading while permitting high volume log processing.

The foregoing and other objects of the invention are realized by providing a conveyor system having a debarker infeed conveyor incorporating a track-chain conveyor, a debarker outfeed conveyor incorporating a track-chain conveyor, a log loading conveyor incorporating a track-chain conveyor for receiving debarked logs in line, and a chipper infeed conveyor, also preferably incorporating a track-chain conveyor.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings, all of which form a part of this specification.

DETAILED DESCRIPTION OF THE PRESENTLY PREFERRED EXEMPLARY EMBODIMENT

The invention is described herein below with reference to the Figures which fully disclose the structure of the invention.

Figure 1:
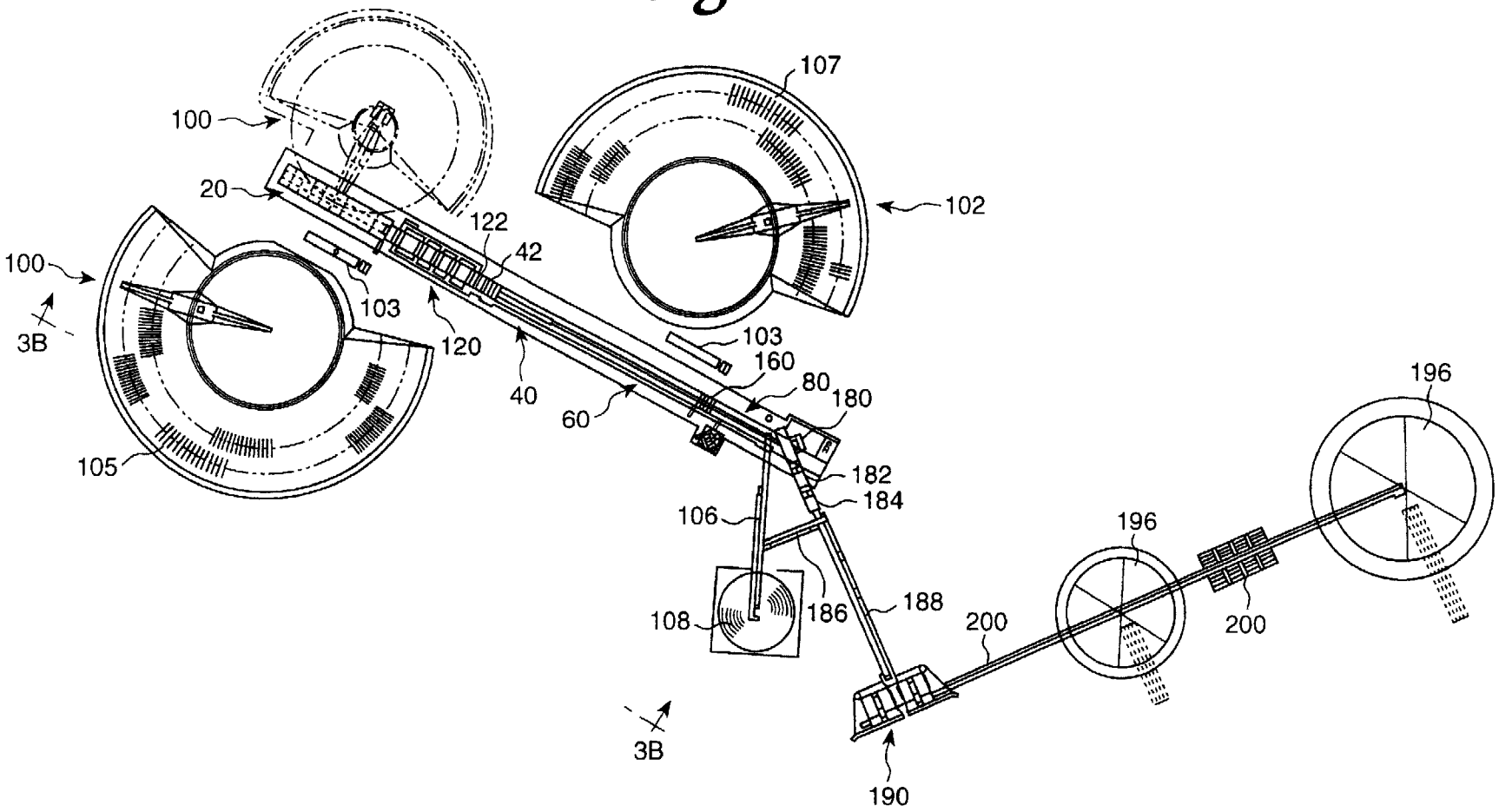
FIG. 1 is a schematic elevational view of a log processing facility incorporating a conveyor system provided in accordance with the present invention.
Figure 2:
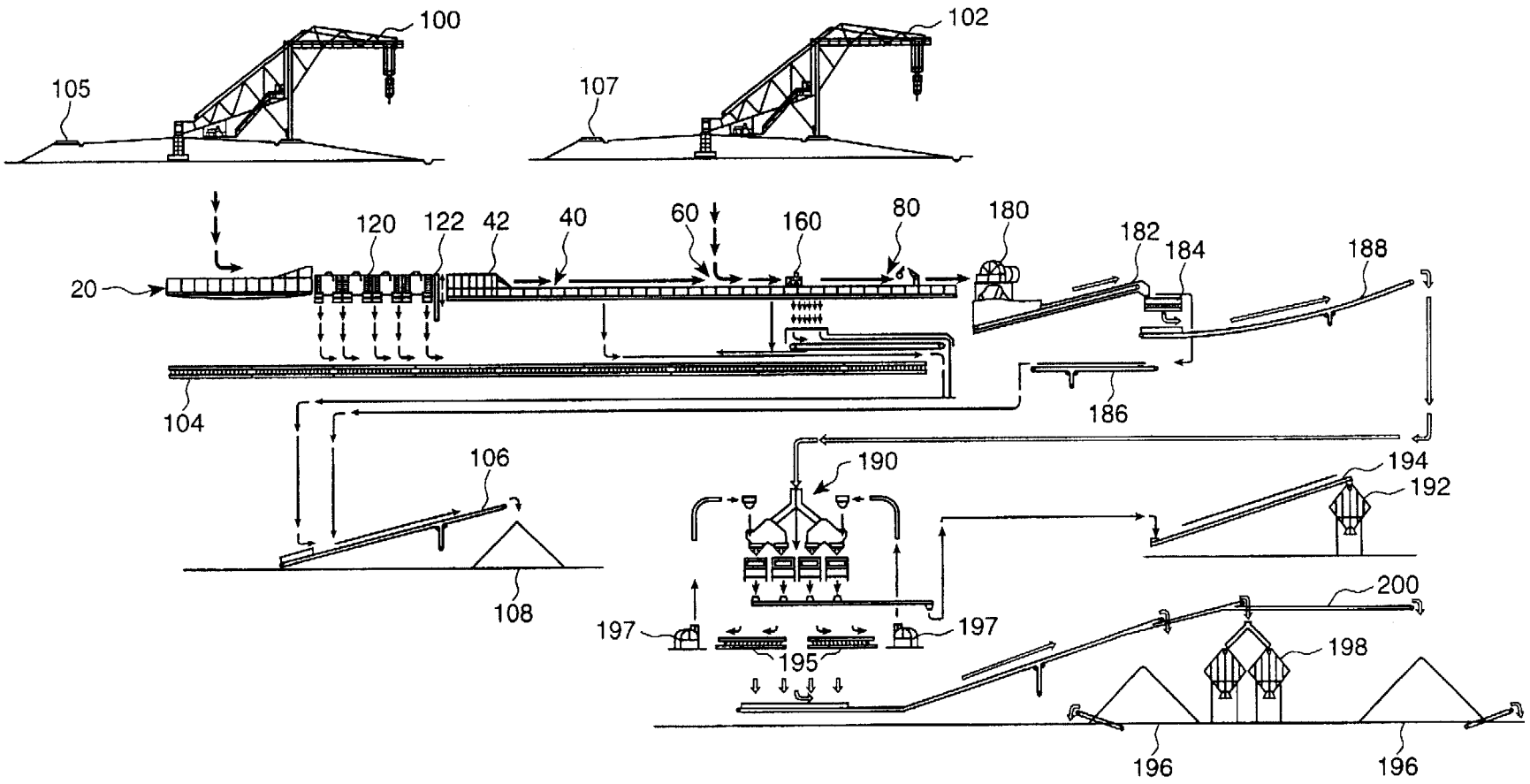
FIG. 2 is a plan view of a log processing facility incorporating the conveyor system of the invention.
Figure 3A:
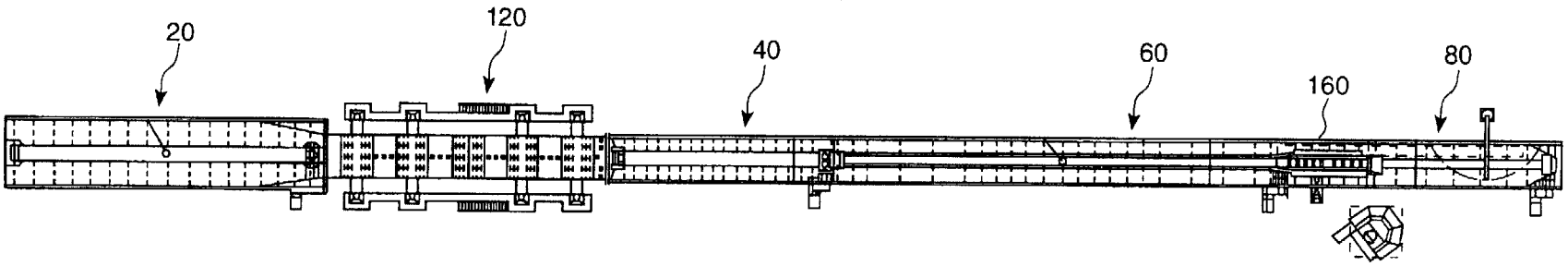
FIG. 3A is a plan view of the conveyor system of FIG. 3B.
Figure 3B:
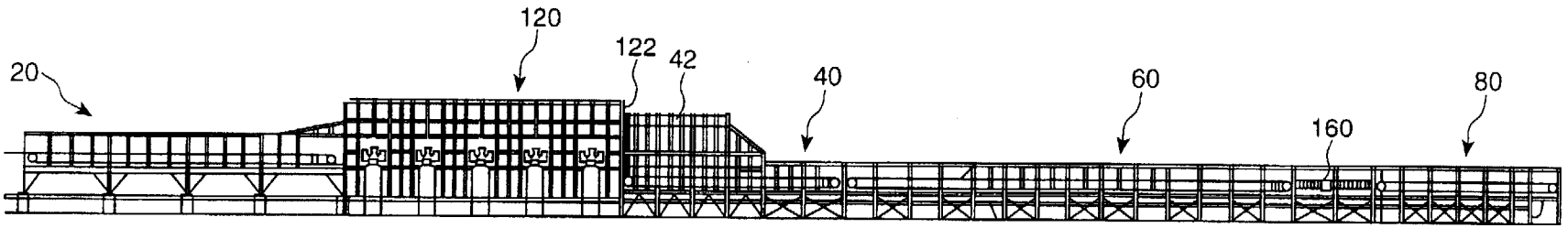
FIG. 3B is an elevational view of the conveyor system of the invention taken alone line 3B—3B in FIG. 1.

A log processing facility provided in accordance with the invention, as shown generally in FIGS. 1–3, comprises a series of log/wood processing components interconnected by conveying or product transporting systems. The conveying systems include a debarker infeed conveyor system 20, a debarker outfeed conveyor system 40, a log loading conveyor system 60, and a chipper infeed conveyor system 80. The processing facility of the invention is adapted to a long life, on the order of 25 years, and is adapted to process large volumes of logs for debarking and chipping, but requires low maintenance and virtually no repair and/or replacement of parts. The debarker infeed and outfeed conveyor systems 20 and 40, the log loading conveyor system 60, and the chipper infeed conveyor system 80 are in particular adapted to high impact by incorporating a track-chain type conveyor system. Because the present invention can withstand high impacts, it is suited for processing high density woods including, for example, eucalyptus logs.

Moreover, such a system is low maintenance inasmuch as the system itself should never need to be replaced. First, the track-chain conveyors of the present invention have useful lives ten to twenty times longer than conventional conveyor tracks. Second, in the event protruding segments or shoes of the track, as described below, wear, they may be repaired by welding add-ons.

The conveyor systems 20, 40, 60, and 80 transport logs to and from various stages of the log processing system. More particularly, barked and debarked logs are transported to the facility by tractor-trailers 103. Barked logs are unloaded by cranes 100 and are stored in barked log storage 105. Debarked logs are unloaded by crane 102 and are stored in debarked log storage 107. Thereafter, logs are loaded by the cranes 100 and 102 onto the processing system from the storage piles as detailed below. Barked logs are loaded onto the debarker infeed conveyor system 20 by debarker cranes 100. The dual cranes reduce the intermittent loading associated with low capacity systems. Previously debarked logs are loaded onto the log loading conveyor system 60 by crane 102.

Figure 4A:
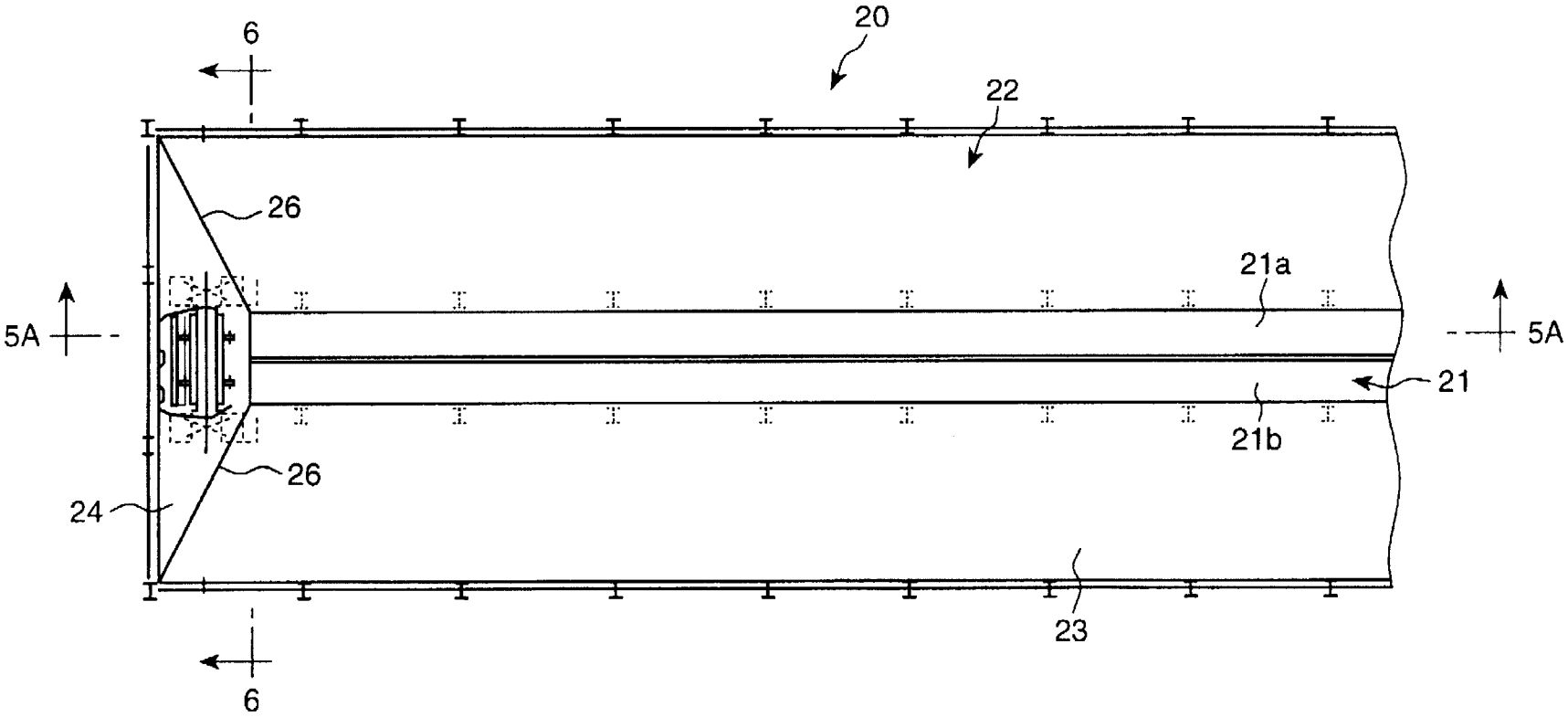
FIGS. 4A and 4B constitute a plan view of a debarker infeed conveyor in accordance with the invention.
Figure 4B:
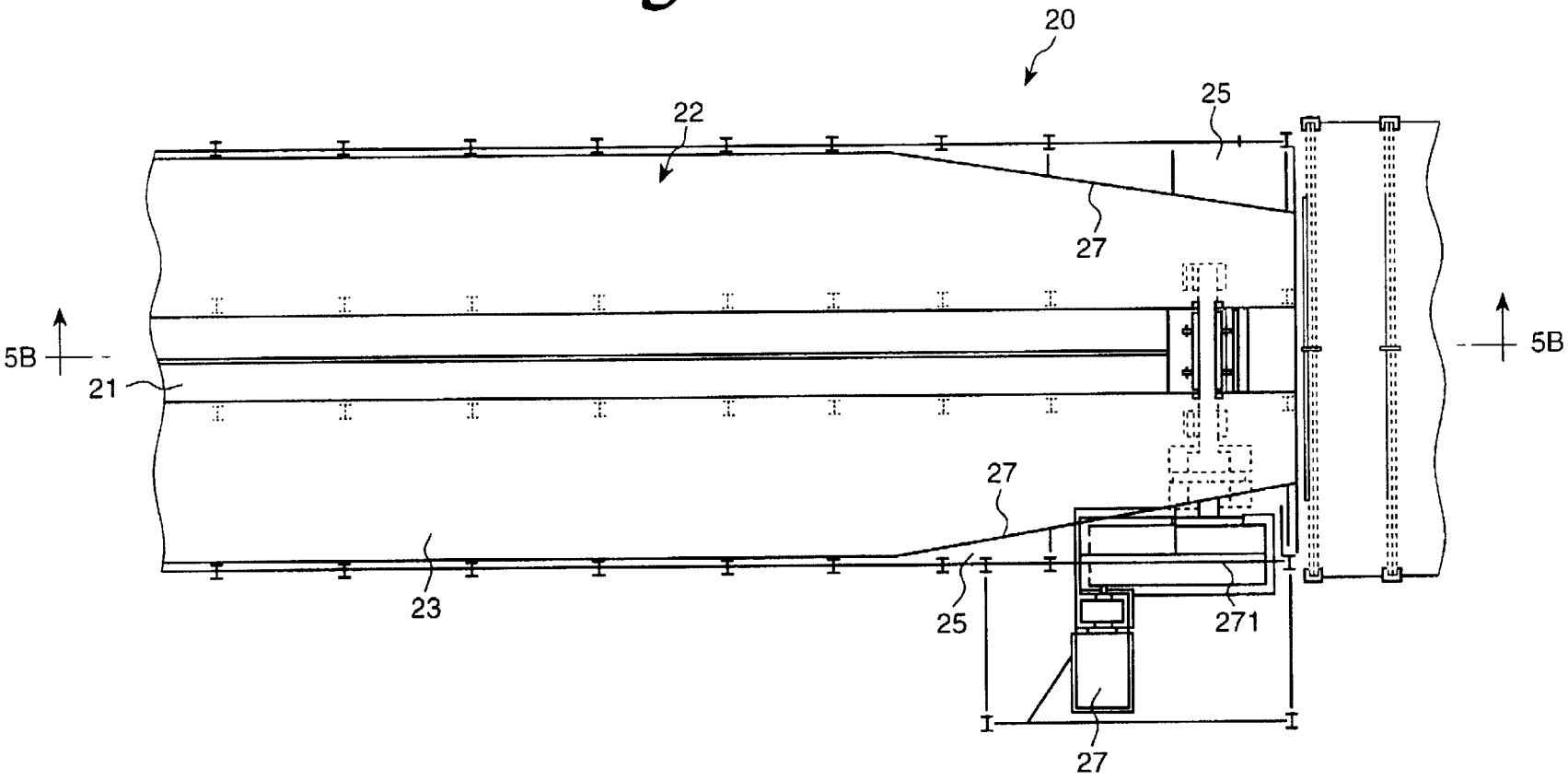
Figure 5A:
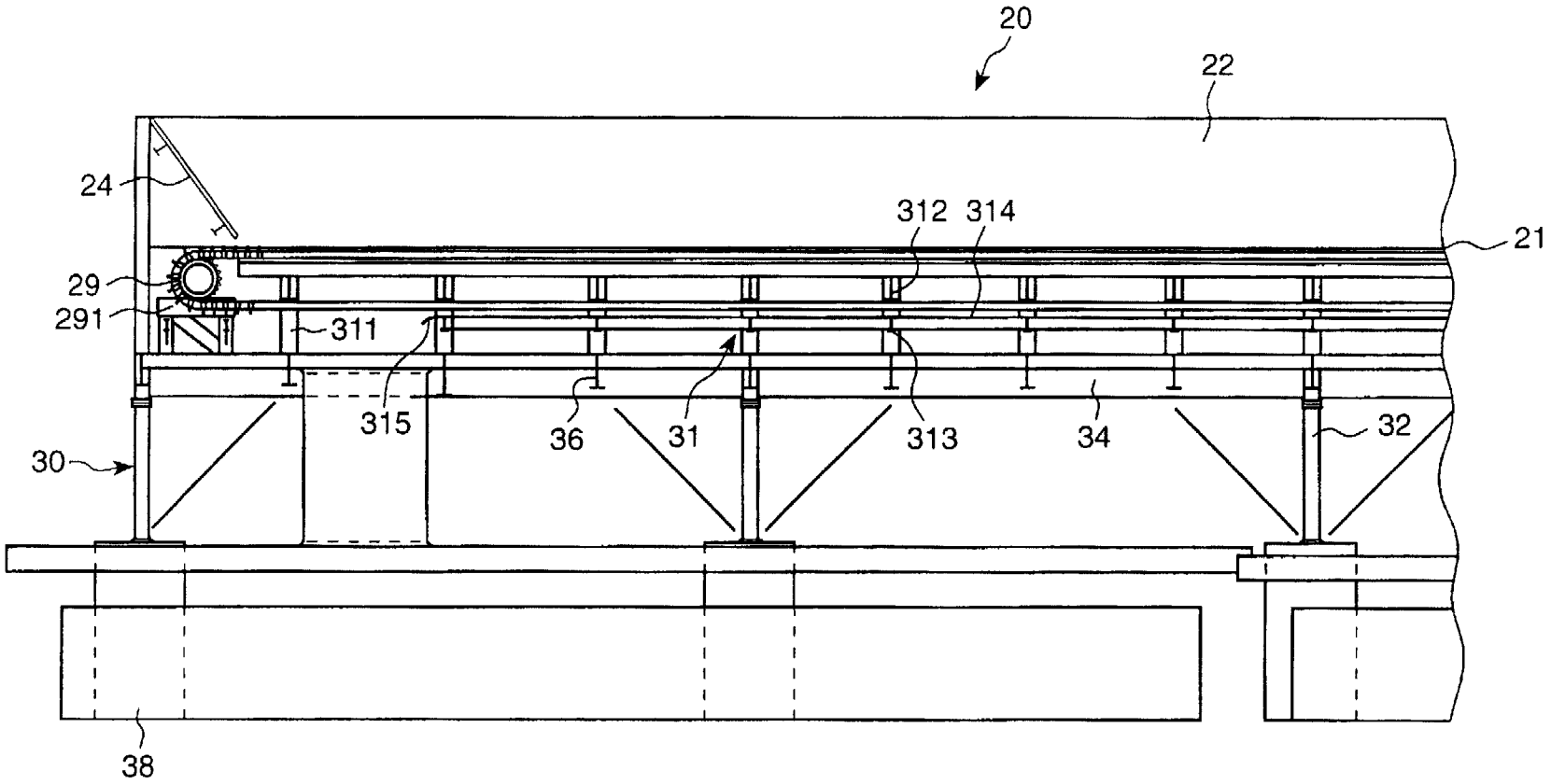
FIG. 5 is a sectional view along line 5A—5A in FIG. 4A.
FIG. 5B is a sectional view along line 5B—5B in FIG. 4B.
Figure 5B:
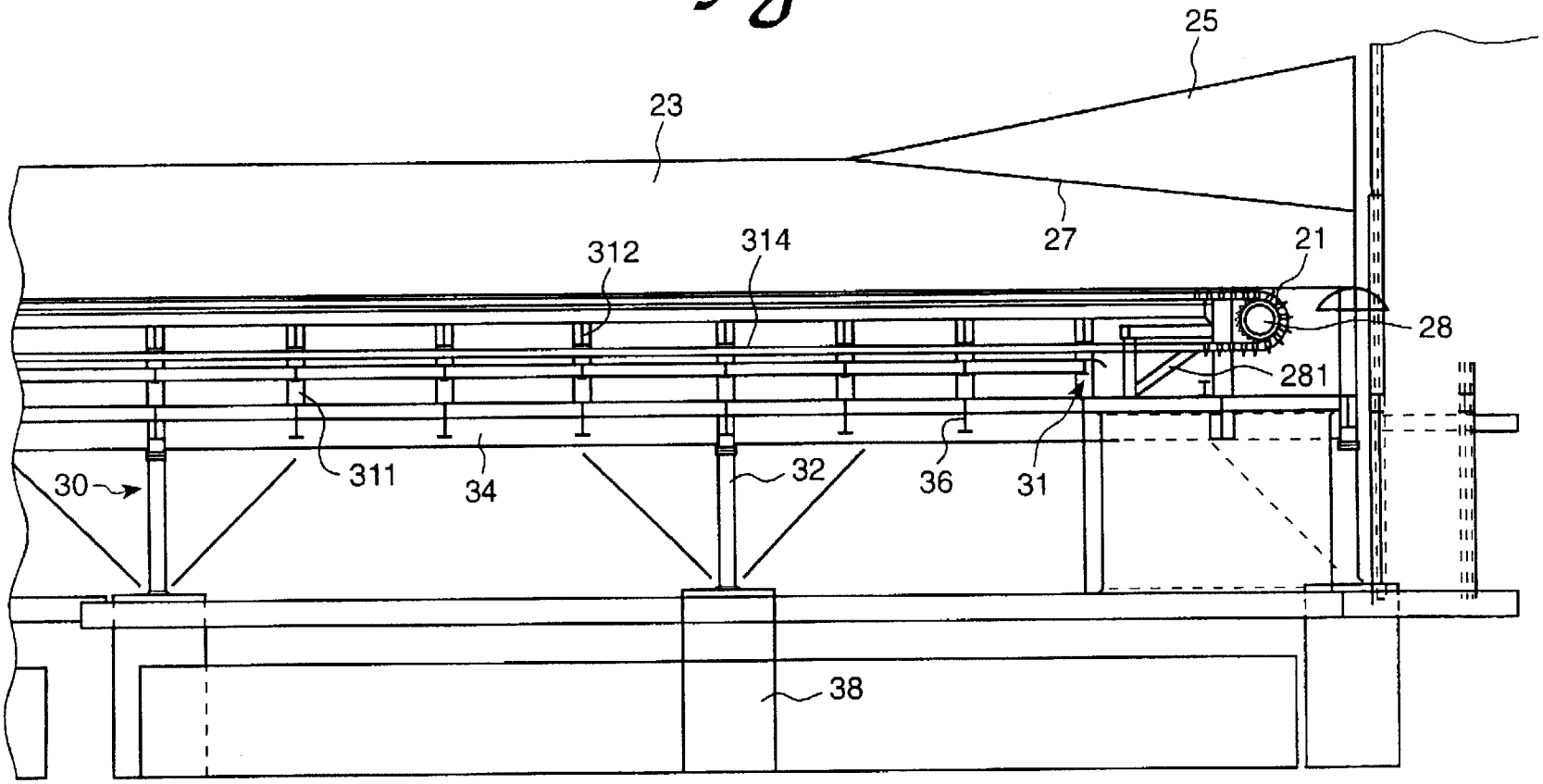
Figure 6:
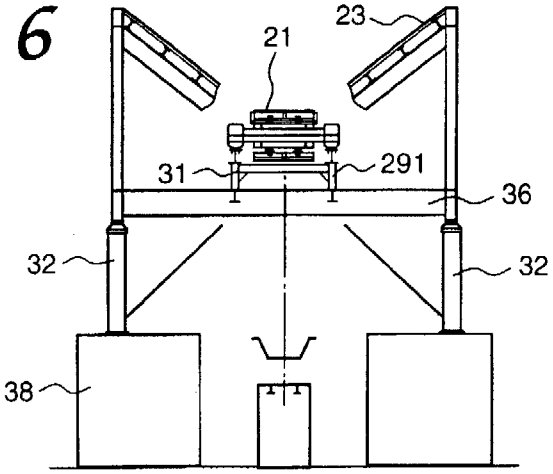
FIG. 6 is a view taken along line 6—6 in FIG. 4A.

As noted above, as a first stage of processing, barked logs are passed from storage 106 to the debarker infeed conveyor system 20 by cranes 100 for conveyance to a debarker 120. The debarker infeed conveyor system 20 is a non-covered, motorized track-chain conveying system. As shown in FIGS. 4–6, the debarker infeed conveyor system 20 includes a trough 22 circumscribing a track-chain conveyor 21 along the conveyor's length. The trough 22 is defined by two inclined sides 23 disposed to contain the logs transported by the conveyor 21. The sides 23 are inclined between 15 and 55 degrees above horizontal and are between 1 and 5 meters wide. In the preferred embodiment, the sides 23 are inclined approximately 36 degrees above horizontal and are nominally 3 meters wide.

The trough 22 is further defined by an inclined plate 24 at the entry end of the conveyor 21 and guide plates 25 at the terminal end of the conveyor 21. The inclined plate 24 is between 2 and 3 meters long and is inclined between 30 and 80 degrees. In the preferred embodiment, the inclined plate 24 is nominally 2.25 meters long and is inclined approximately 53 degrees above horizontal. It is affixed to the sides 23 along lines 26. The inclined plate 24 and the sides 23 guide and direct the logs loaded by the cranes 100 toward the conveyor 21.

At the terminal end, the inclined sides 23 taper inwardly and downwardly towards the conveyor 21 and are affixed to the guide plates 25 such that the guide plates 25 are substantially vertical. The sides 23 taper inwardly approximately along the final 6 meters of the terminal end of the infeed conveyor system 20. The guide plates 25 are affixed to the sides 23 along lines 27. This configuration funnels the logs into the debarker entrance. Moreover, the vertical guide plates 25 protect system operators from unintentional ejection of logs kicked out by the debarker 120.

The trough 22 is affixed to a frame designated generally by reference 30. In accordance with this embodiment, the frame 30 includes vertical support members 32, horizontal members 34, and lateral members 36. The frame 30 is constructed such that two horizontal members 34 are positioned parallel below the length of the infeed conveyor 21. One of a pair of vertical support members 32 is affixed perpendicularly to each of the horizontal members 34 at both the entry end and the terminal end of the infeed conveyor system 20. Thereafter, additional pairs of vertical support members 32 are affixed perpendicularly to the horizontal members 34 whereby all pairs of vertical support members 32 are spaced nominally 7.5 meters apart. As constructed, the frame 30 attaches to a foundation 38 at a base of each vertical support member 32. Finally, lateral members 36 are affixed perpendicularly between the horizontal members 34 beginning at the entry end and concluding at the terminal end and are spaced nominally 2 meters apart. The frame 30 is constructed to support a subframe 31 fixedly mounted to the lateral members 36 of the frame 30.

The subframe 31 is constructed to support the conveyor 21. In the illustrated embodiment, a pair of vertical members 311 of the subframe 31 is affixed to each of the lateral members 36 exclusive of the lateral members at the entry and terminal ends and are spaced nominally 1.6 meters apart along the lateral members 36. Thereafter, an upper cross member 312 and a lower cross member 313 are affixed perpendicularly between each of the pairs of vertical members 311 thereby providing a pathway 314 for the return of the conveyor 21. As constructed, the pathway 314 is approximately 0.5 meters high by 1.5 meters wide. A brace 315 affixed to the lower cross members 313 further braces the subframe 31. The members of the frame 30 and subframe 31 are, for example, I beams. The frame 30 and subframe 31 are designed and sized to withstand the loading and impact anticipated for the processing system.

The debarker infeed conveyor 21 receives crane loaded (high impact) barked logs and conveys these logs into the debarker 120. The design capacity of this conveyor is 250 metric tons per hour with a track-chain speed of 15 meters per minute. A preferred conveyor track in accordance with the invention is a Caterpillar D4H Quad Link track with shoes.

Figure 17A:
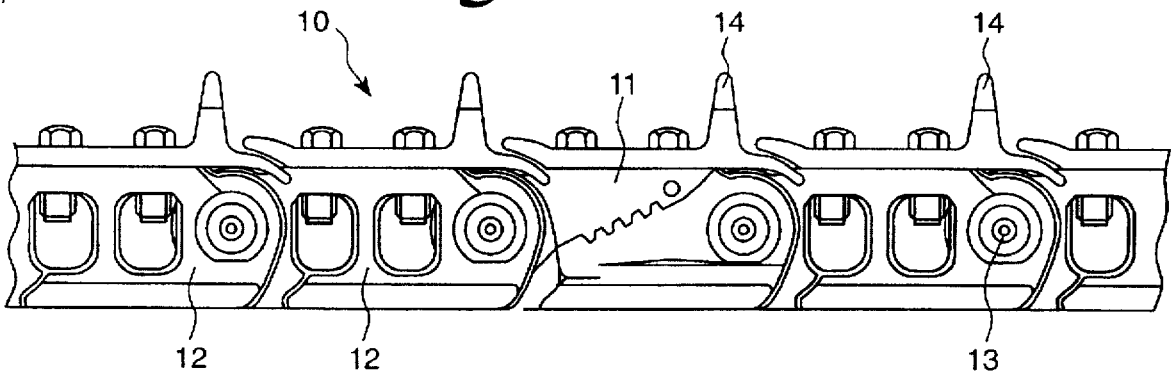
FIG. 17A is an elevational view of a Quad Link track in accordance with the invention.
Figure 17B:
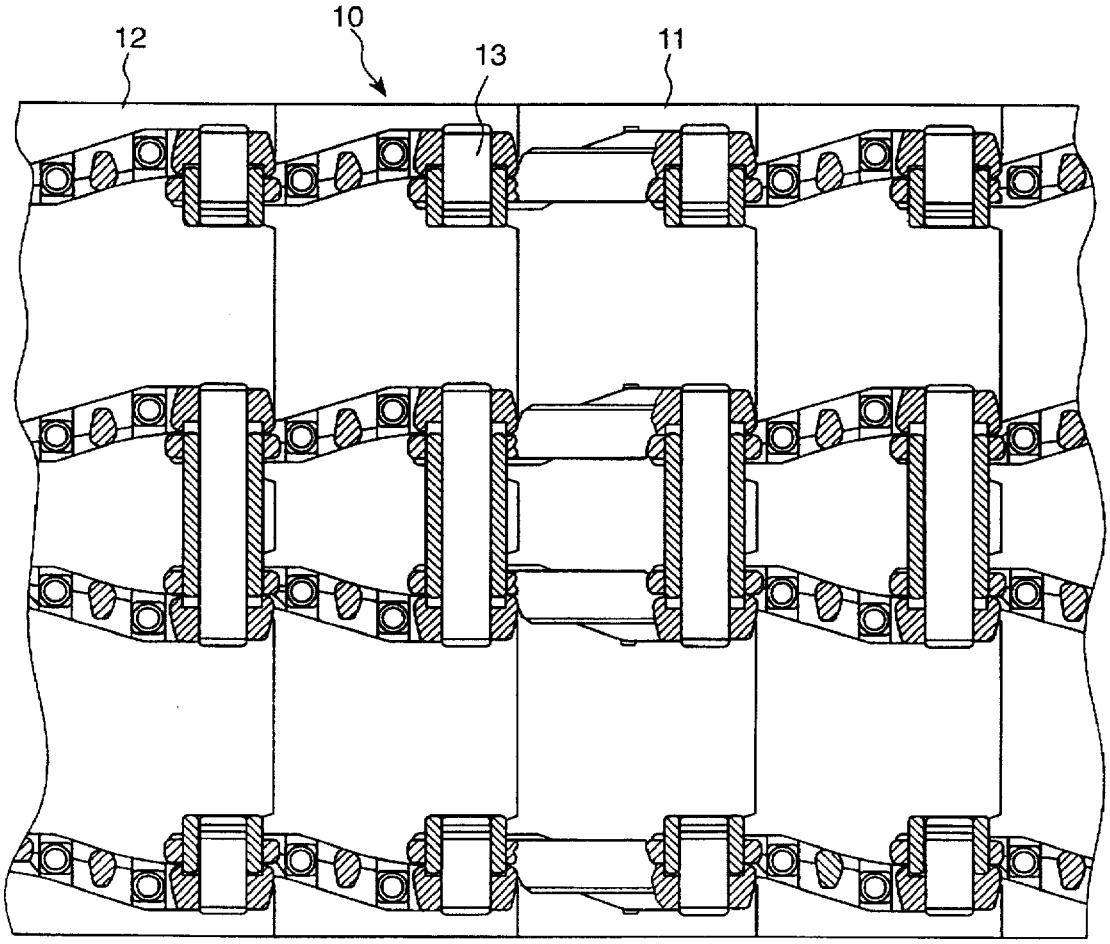
FIG. 17B is a plan view of the track of FIG. 17A.

As shown in FIGS. 17A and 17B, a preferred Quad Link track is designated generally by the reference number 10. The Quad Link track 10 includes a split master link 11 that provides, as with conventional track, the ability to size the track on site. Each link 12 of the Quad Link track 10 includes a sealed pin and bushing assembly 13 that connects each link together and affords reduced wear and longer life. Further, the sealed assembly 13 keeps foreign material out of the joint. The master link 11 allows each of the sealed assemblies 13 to be lubricated and sealed at locations away from the factory. Shoes 14 are attached to each link 12 and provide a bearing surface upon which the logs ride.

In this embodiment, the conveyor 21 includes two parallel tracks **21*a* and 21*b***. As assembled, each track includes nine sections 7358 mm long with one shoe per link. Each shoe is 590 mm wide. Dual tracks are provided to accommodate larger quantities of logs during the loading stage. The dual track configuration can accommodate approximately 3–4 logs across its width. A single track configuration may be used when there is a requirement to meter the number or flow of logs. The single track configuration can accommodate approximately 1–2 logs across its width.

In the illustrated embodiment, the track-chain system is powered by a 132 Kw motor 27 through a direct coupled reducer 271 engaged to a head sprocket 28 mounted on a head sprocket deck 281. Upon engagement, the head sprocket 28 drives the conveyor 21. The conveyor 21 returns via the pathway 314 and engages a free tail sprocket 29 mounted on a tail sprocket deck 291. The general dimensions of the debarker infeed conveyor system 20 in accordance with the illustrated embodiment are approximately 32,000 mm (32 meters) long by 6,300 mm (6.3 meters) wide.

The debarker 120 provided intermediate the debarker infeed and outfeed conveyor systems 20 and 40 is of known design or may be a proprietary debarking drum of the manufacturer, provided the debarker is adapted to receive logs of the size and at a rate anticipated for the processing system as whole. In this embodiment, the debarker 120 debarks the logs by rotating the logs inside the drum at approximately 9 revolutions per minute. As shown in FIG. 2, refuse bark removed from the logs falls to a vibrating conveyor 104 positioned below the debarker 120 and is carried to a belt conveyor 106 and, ultimately, to a bark storage 108.

Figure 9:
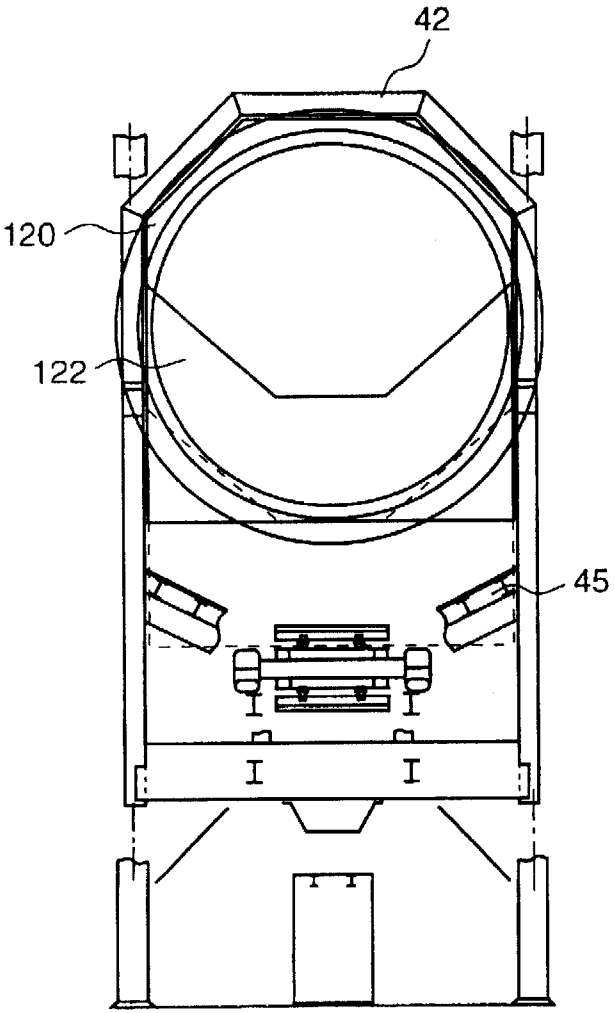
FIG. 9 is a view taken along line 9—9 in FIG. 7.

At the terminal end of the debarker 120, a discharge gate 122 limits outflow of the logs thereby controlling the residence of the logs in the debarker until the logs are substantially debarked. After debarking, the logs exit the debarker. 120 and pass by the lowered discharge gate 122 to the debarker outfeed conveyor system 40. When the hydraulic gate 122 is lowered, as shown by the broken line in FIG. 9, a debarker outfeed conveyor housing 42 protects system operators from the unintentional ejection of logs and debris kicked out by the spinning debarker 120 and contains the logs for transport by the debarker outfeed conveyor system 40.

More particularly, the debarker outfeed conveyor system 40 is a partially covered, motorized track-chain conveying system. As shown in the illustrated embodiment of FIGS. 7–10, the debarker outfeed conveyor system 40 includes the housing 42 and a trough 45. The housing 42 is affixed to a frame designated generally by the number 50. The housing 42 encloses a track-chain conveyor 41 for approximately half of the conveyor's length and is constructed to protect system operators from unintentional ejection of logs and debris. The housing 42 is approximately 5.8 meters high in this embodiment and is constructed generally to mate compatibly with the dimensions of the debarker. At a junction 43, the housing 42 opens with walls 44 extended approximately 3.5 meters therefrom and tapered downwardly towards sides 49 of the trough 45.

Figure 7:
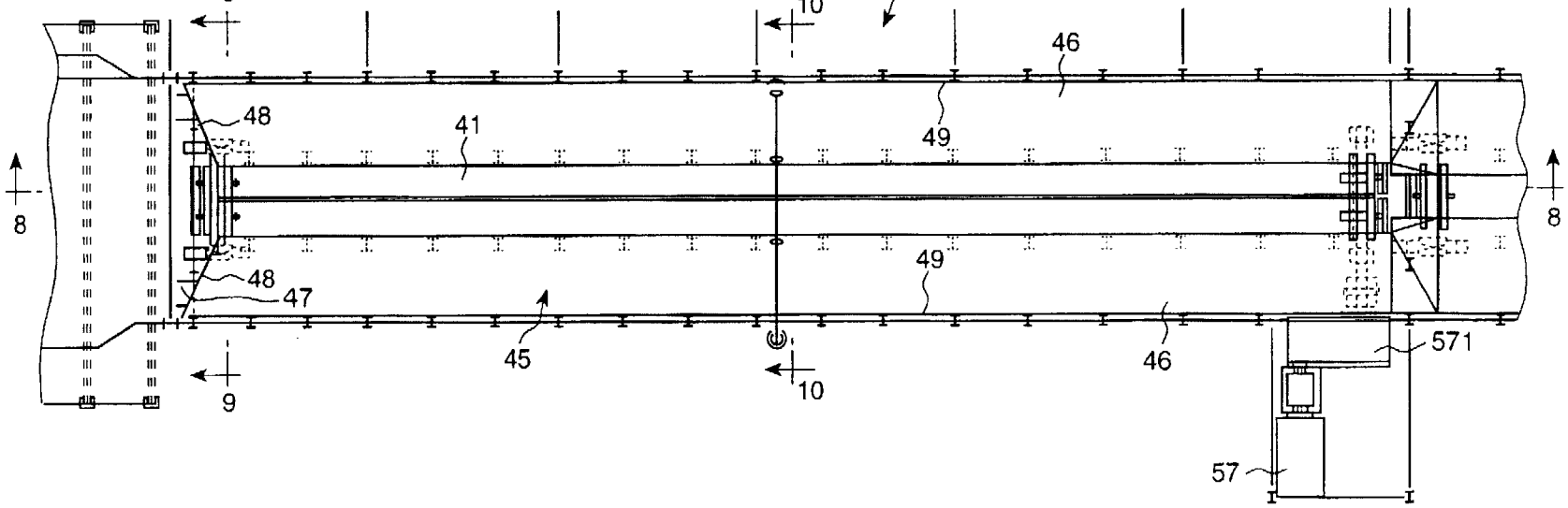
FIG. 7 is a plan view of a debarker outfeed conveyor in accordance with the invention.
Figure 8:
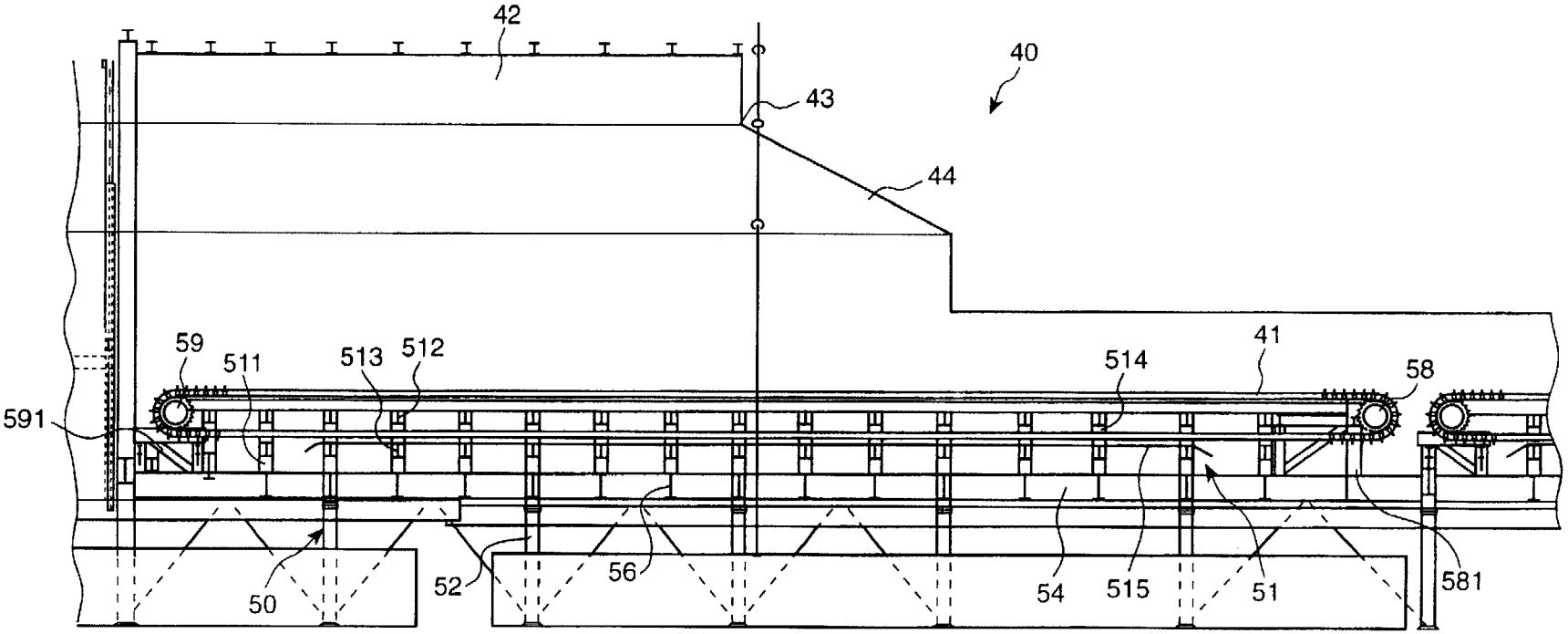
FIG. 8 is a sectional view taken along line 8—8 of FIG. 7.
Figure 10:
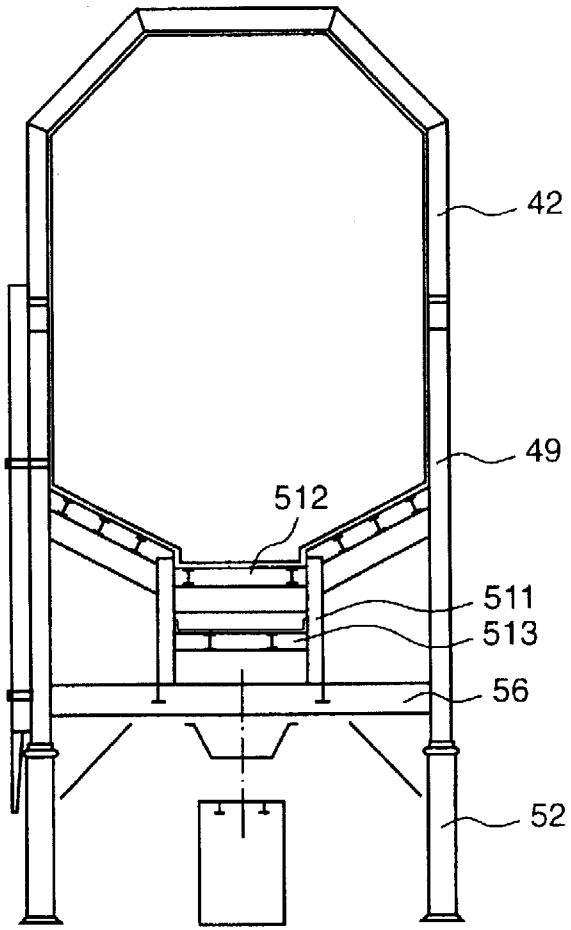
FIG. 10 is a view taken along line 10—10 in FIG. 7.

As best shown in FIG. 7, the trough 45 partially circumscribes the conveyor 41 about the conveyor's length. The trough 45 is defined by two inclined sides 46 and by the two vertical sides 49 positioned to contain the logs transported by the conveyor 41. The sides 46 are inclined between 10 and 50 degrees and are between 1 and 3 meters wide. In the preferred embodiment, the sides 46 are inclined approximately 27 degrees above horizontal and are nominally 1.6 meters wide extending from the conveyor 41 to the vertical sides 49. The vertical sides 49 are approximately 0.5 meters in height above the inclined sides 46. The vertical sides 49 are sized to withstand the impact of flailing, dense logs. The trough 45 is further defined by an inclined plate 47 at the entry end of the conveyor 41. The inclined plate 47 is nominally one meter long, and it is affixed to the sides 46 along lines 48. At the terminal end, the trough 45 mates compatibly with the trough 62 of the log loading conveyor 60. Additional plates are provided at the interface between the debarker outfeed conveyor 40 and the log loading conveyor 60 so that transported logs are funneled from the dual track configuration of the outfeed conveyor 40 to the single track configuration of the log loading conveyor 60.

In a manner similar to the infeed conveyor trough 22, as described above, the trough 45 is affixed to the frame 50. In the illustrated embodiment, the frame 50 includes vertical support members 52, horizontal members 54, and lateral members 56. The frame 50 is constructed such that two horizontal members 54 are positioned parallel below the length of the outfeed conveyor 41. One of a pair of vertical support members 52 is affixed perpendicularly to each of the horizontal members 54 at both the entry end and the terminal end of the outfeed conveyor system 40. Thereafter, additional pairs of vertical support members 52 are affixed perpendicularly to the horizontal members 54 whereby pairs of vertical support members 52 below the housing 42 are spaced nominally 3.5 meters apart and thereafter are spaced nominally 4.1 meters apart. Finally, lateral members 56 are affixed perpendicularly between the horizontal members 54 beginning at the entry end and concluding at the terminal end and are spaced nominally one meter apart. The frame 50 is constructed to support a subframe 51 fixedly mounted to the lateral members 56 of the frame 50.

The subframe 51 is constructed to support the conveyor 41. In accordance with this embodiment, a pair of vertical members 511 of the subframe 51 is affixed to each of the lateral members 56 exclusive of the lateral members at the entry and terminal ends and are spaced nominally 1.6 meters apart along the lateral members 56. Thereafter, an upper cross member 512 and a lower cross member 513 are affixed perpendicularly between each of the pairs of vertical members 511 thereby providing a pathway 514 for the return of the conveyor 41. As constructed, the pathway 514 is approximately 0.5 meters high by 1.5 meters wide. A brace 515 affixed to the lower cross member 513 further braces the subframe 51. The members of the frame 50 and subframe 51 are, for example I beams. The frame 50 and the subframe 51 are designed and sized to withstand the loading and impact anticipated for the processing system.

The debarker outfeed conveyor 41 conveys debarked logs to the log loading conveyor 60. The design capacity of this conveyor is 250 metric tons per hour with a track-chain speed of 31 meters per minute. In this embodiment, the conveyor 41 includes two parallel tracks **41*a* and 41*b*. As assembled, each track includes six sections 7358 mm long with one shoe per link. Each shoe is 590 mm wide. A description of the Quad Link track and the track shoe is provided above and is omitted here. In this embodiment, the track-chain conveyor 41 for the debarker outfeed conveyor system 40 is also powered by a 132 Kw motor 57 through a direct coupled reducer 571 to a head sprocket 58 mounted on a head sprocket deck 581. Upon engagement, the head sprocket 58 drives the conveyor 41. The conveyor 41 returns via the pathway 514 and engages a free tail sprocket 59 mounted on a tail sprocket deck 591**. The general dimensions of the conveyor structure are approximately 22,200 mm (22.2 meters) long by 4,400 mm (4.4 meters) wide.

Figure 11A:
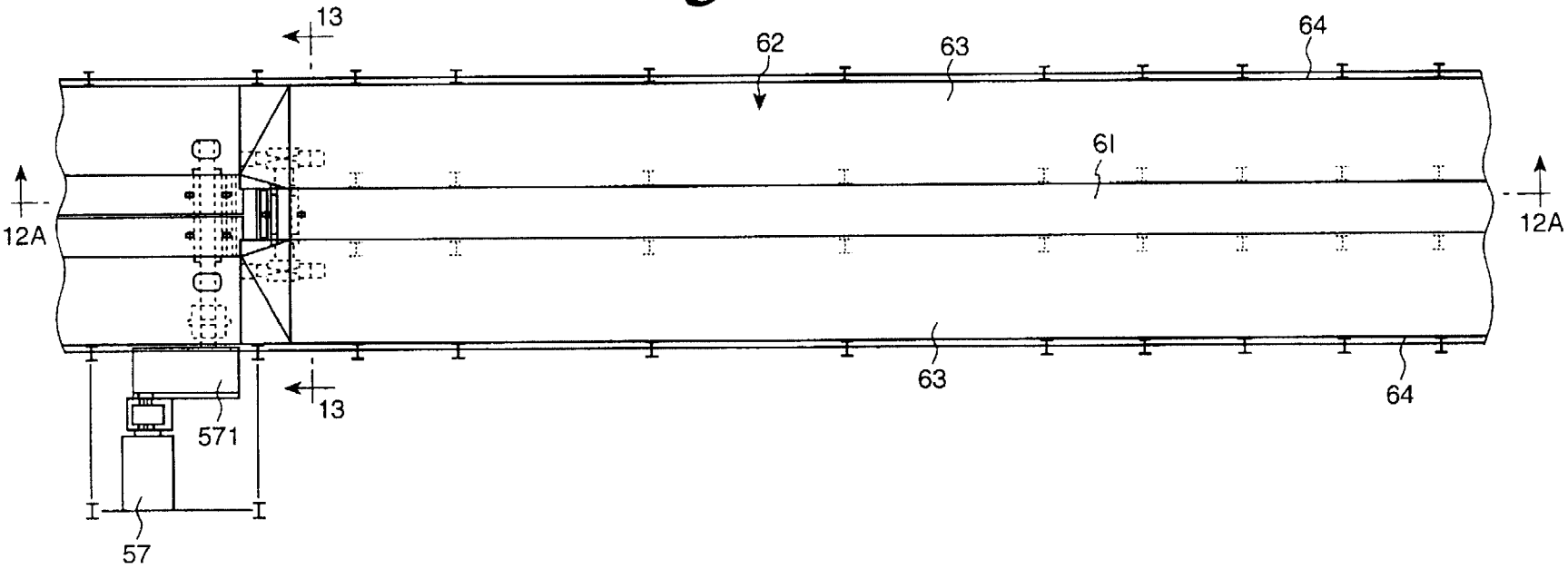
FIGS. 11A and 11B constitute a plan view of a log loading conveyor in accordance with the invention.
Figure 11B:
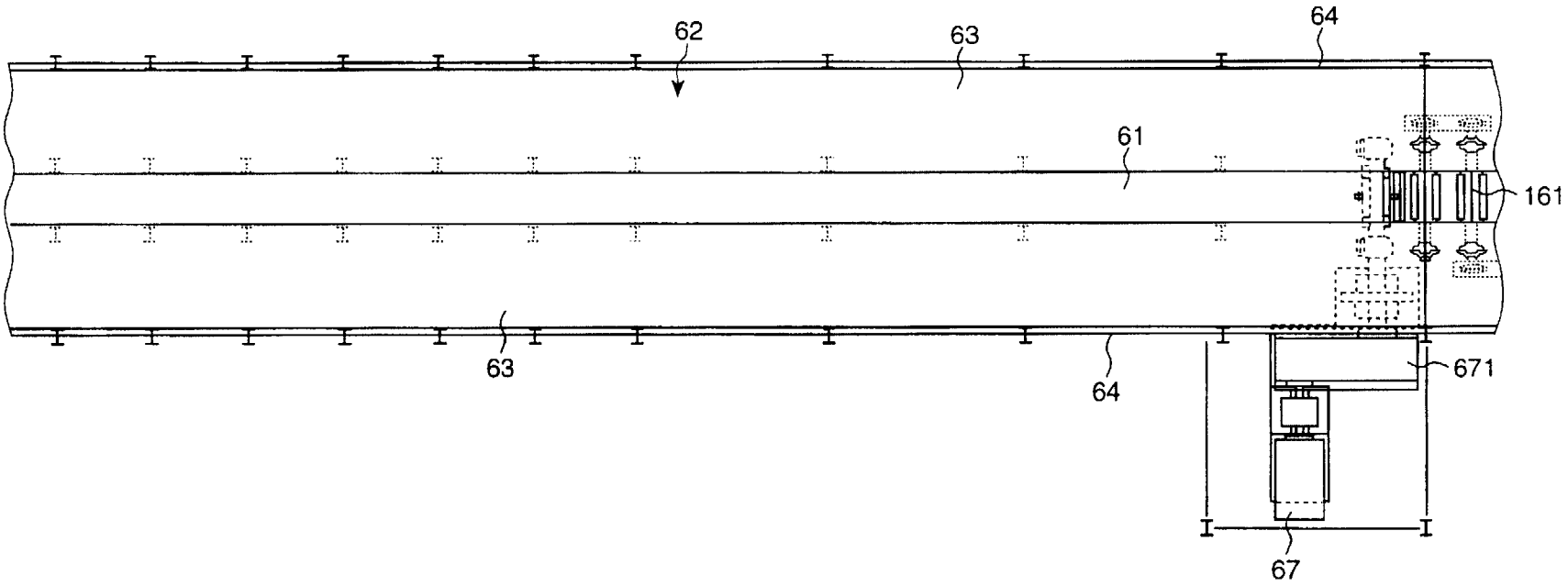
Figure 12A:
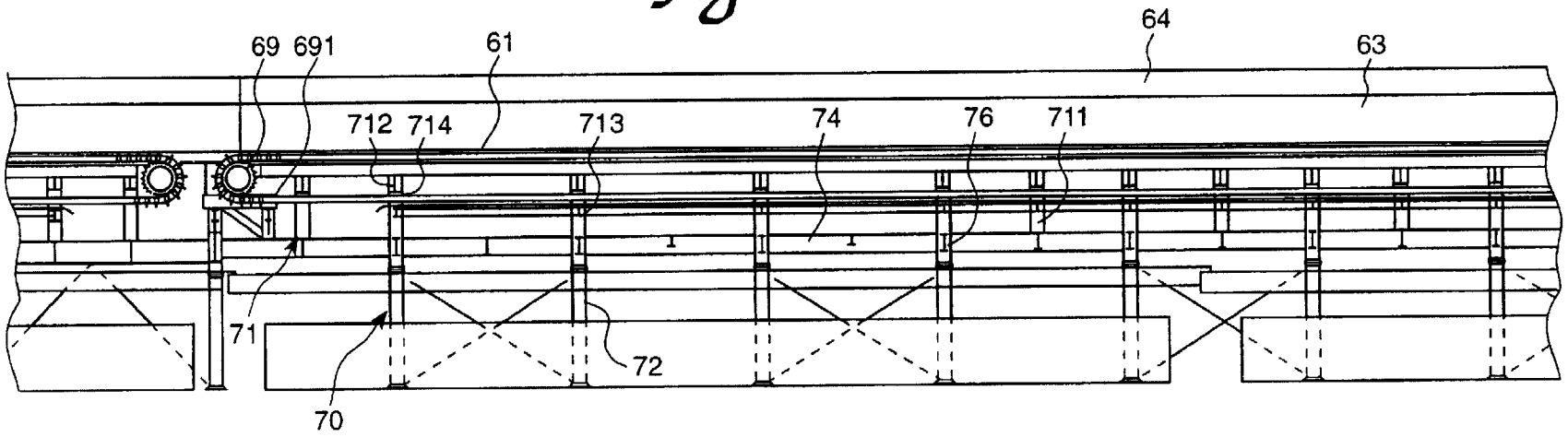
FIG. 12A is a sectional view along line 12A—12A in FIG. 11A.
Figure 12B:
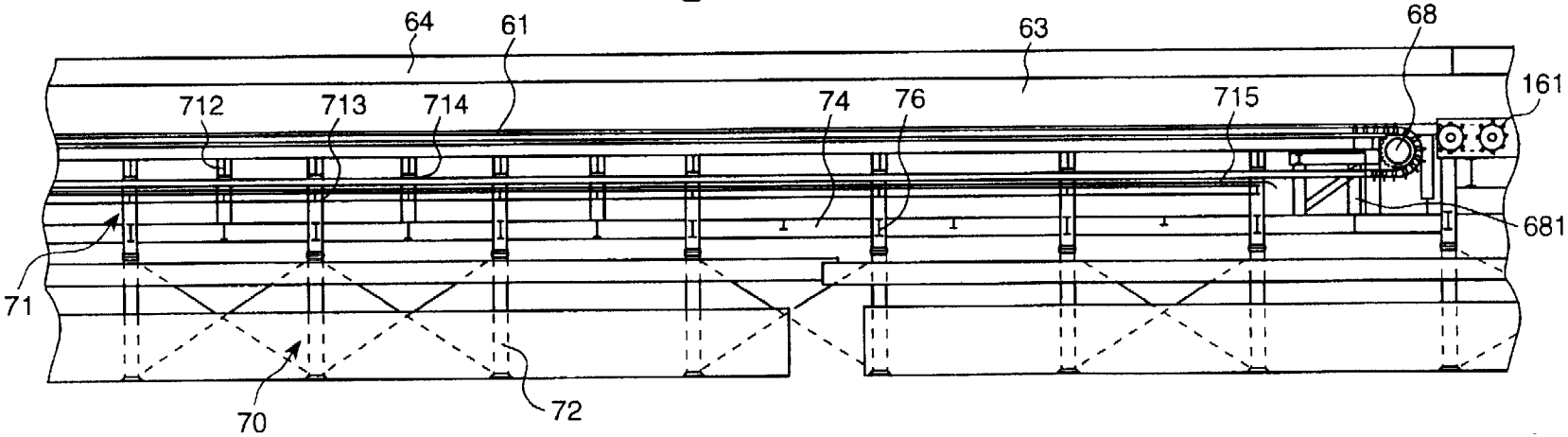
FIG. 12B is a sectional view along line 12B—12B in FIG. 11B.
Figure 13:
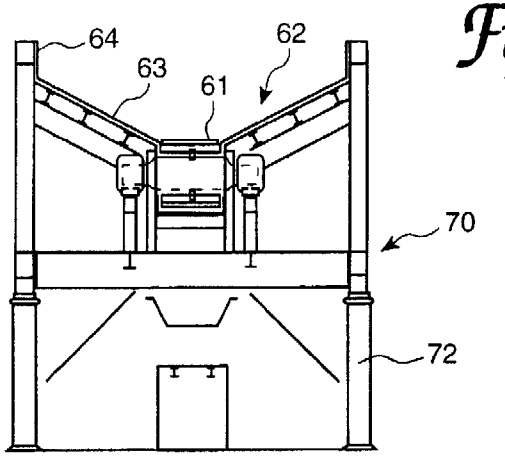
FIG. 13 is a view taken along line 13—13 in FIG. 11A.

Thereafter, the debarked logs pass from the debarker outfeed conveyor system 40 to the log loading conveyor system 60. At this stage in the present embodiment, previously debarked logs stored in debarked log storage 107 may be loaded onto the processing system with the log loading crane 102. The log loading conveyor system 60 conveys the debarked logs to a log washer 160. More particularly, the log loading conveyor system 60 is a non-covered, motorized track-chain conveying system. As shown in FIGS. 11–13, the log loading conveyor system 60 includes a trough 62 formed by two inclined sides 63 and two vertical sides 64 positioned parallel to the conveyor 61 thereby containing the logs transported by the conveyor 61. The sides 63 are inclined between 10 and 50 degrees and are between 1 and 3 meters wide. In the preferred embodiment, the sides 63 are inclined approximately 27 degrees above horizontal and are nominally 1.9 meters wide extending from the conveyor 61 to the vertical sides 64. The vertical sides 64 are extended approximately 0.5 meters above the inclined sides 63. As described above, the trough 62 is further defined at the entry end by additional plates that provide the transition from a dual track configuration to a single track configuration.

In a manner similar to the infeed conveyor trough 22, as described above, the trough 62 is affixed to a frame 70. The frame 70, as illustrated in this embodiment, includes vertical support members 72, horizontal members 74, and lateral members 76. The frame 70 is constructed such that two horizontal members 74 are positioned parallel below the length of the log loading conveyor 61. One of a pair of vertical support members 72 is affixed perpendicularly to each of the horizontal members 64 at both the entry end and the terminal end of the log loading conveyor system 60. Thereafter, additional pairs of vertical support members 72 are affixed perpendicularly to the horizontal members 74 and are spaced nominally 3.2 meters apart. Finally, lateral members 76 are affixed perpendicularly between the horizontal members 74 beginning at the entry end and concluding at the terminal end and are spaced nominally 3 meters apart in a entry portion, 1.5 meters apart in a center portion, and 3 meters apart in a terminal portion. The frame 70 is constructed to support a subframe 71 fixedly mounted to the lateral members 76 of the frame 70.

The subframe 71 is constructed to support the conveyor 61. In this embodiment, a pair of vertical members 711 of the subframe 71 is affixed to each of the lateral members 76 exclusive of the lateral members at the entry and terminal ends and are spaced nominally 1.1 meters apart along the lateral members 76. Thereafter, an upper cross member 712 and a lower cross member 713 are affixed perpendicularly between each of the pairs of vertical members 711 thereby providing a pathway 714 for the return of the conveyor 61. As constructed, the pathway 714 is approximately 0.5 meters high by 0.9 meters wide. A brace 715 affixed to the lower cross member 713 further braces the subframe 71. The members of the frame 70 and subframe 71 are, for example I beams. The frame 70 and the subframe 71 are designed and sized to withstand the loading and impact anticipated for the processing system.

The log loading conveyor conveys debarked logs and crane loaded (high impact) debarked logs to the log wash conveyor 161. The design capacity of the log loading conveyor 60 is also 250 metric tons per hour with a track-chain speed of 31 meters per minute. In this embodiment, the log loading conveyor 61 is a single track assembled of twelve sections 7358 mm long with one shoe per link. Each shoe is 760 mm wide. At this stage of processing a single track is used to begin metering log flow in anticipation of the input of the logs into the log washer. The single track configuration accommodates 1–2 logs across its width. A description of the Quad link track and the shoe is provided above and is omitted here. The track-chain conveyor 61 is powered by a 132 Kw motor 67 through a direct coupled reducer 671 to a head sprocket 68 mounted on a head sprocket deck 681. Upon engagement, the head sprocket 68 drives the conveyor 61. The conveyor 61 returns via the pathway 714 and engages a free tail sprocket 69 mounted on a tail sprocket deck 691. The general dimensions of the conveyor structure are approximately 44,300 mm (44.3 meters) long by 4,400 mm (4.4 meters) wide.

Logs are transported through the log washer 160 by a log wash conveyor 161. In this embodiment, refuse from the log washer falls to the vibrating conveyor 104 for deposition in the bark storage 108. The log washer 160 provided intermediate the log loading conveyor system 60 and the chipper infeed conveyor system 80 may be of conventional design.

Figure 14:
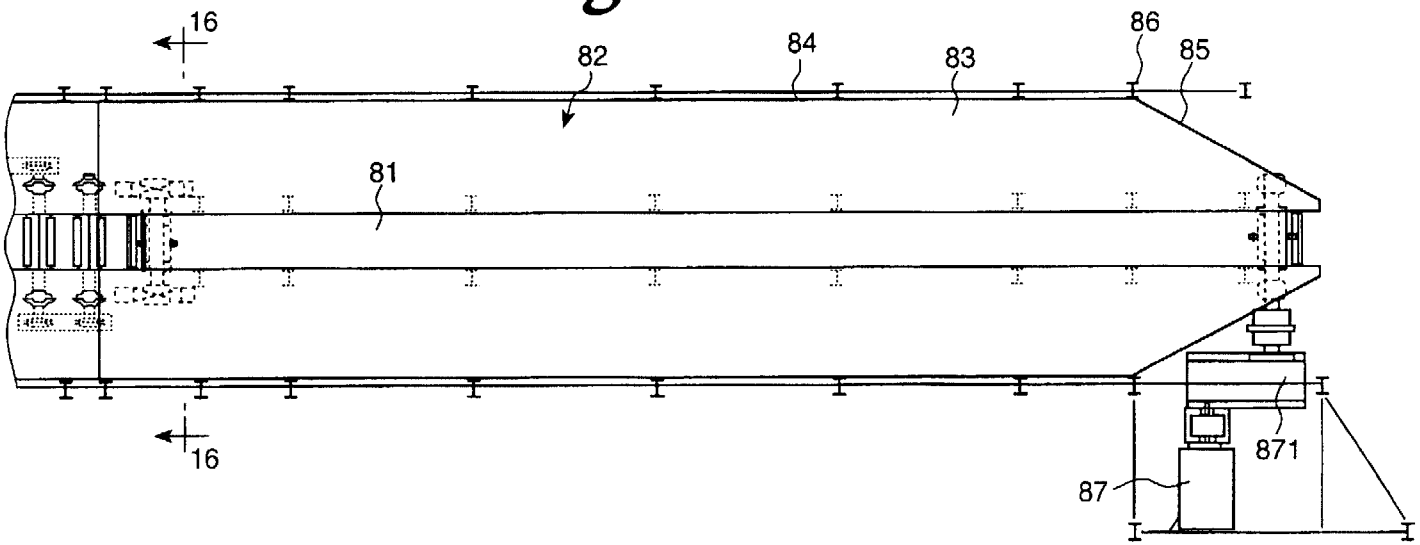
FIG. 14 is a plan view of a chipper infeed conveyor in accordance with the invention.
Figure 15:
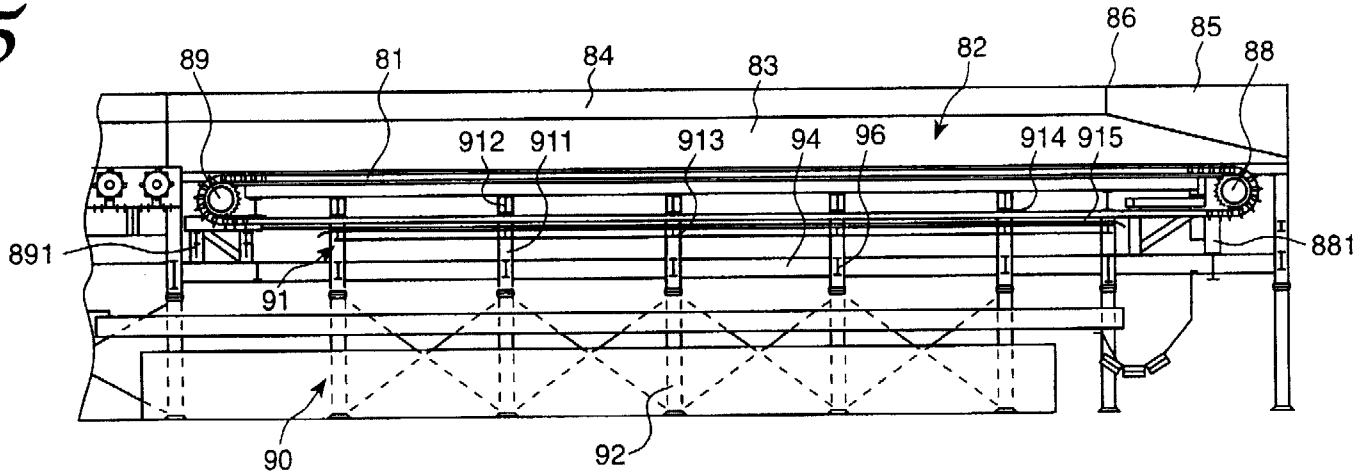
FIG. 15 is an elevational view of a chipper infeed conveyor in accordance with the invention.
Figure 16:
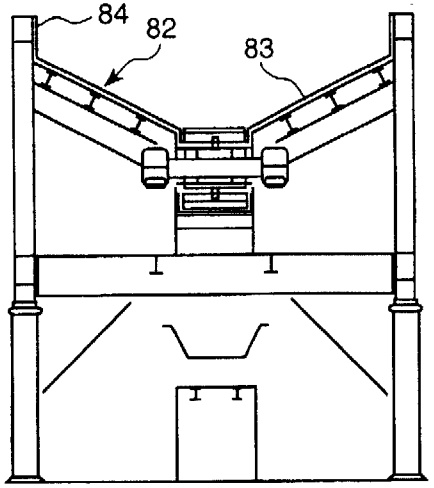
FIG. 16 is a view taken along line 16—16 in FIG. 14.

After washing, the debarked and washed logs pass to a chipper 180 via the chipper infeed conveyor system 80. More particularly, the chipper infeed conveyor system 80 is a non-covered, motorized track-chain conveying system. As shown in FIGS. 14–16, the chipper infeed conveyor system 80 includes a trough 82 formed by two inclined sides 83 and two vertical sides 84 positioned parallel to a conveyor 81 thereby containing the logs transported by the conveyor 81. The sides 83 at the entry end are inclined between 10 and 50 degrees and are between 1 and 3 meters wide. In the preferred embodiment, the sides 83 at the entry end are inclined approximately 27 degrees above horizontal and are nominally 1.9 meters wide extending from the conveyor 81 to the vertical sides 84. The vertical sides 84 are extended approximately 0.5 meters high above the inclined sides 83. As constructed, the entry end of the trough 82 mates compatibly with the terminal end of the trough 62 of the log loading conveyor system 60 thereby providing a continuous trough between the conveyor systems. At the terminal end of the conveyor system 80, the vertical sides 84 taper inwardly towards the chipper 180 thereby forming a funnel 85 over approximately the last 2.8 meters of the trough 82. Sides of the funnel 85 remain vertical and vary in height from 0.5 meters at a point 86 representing the beginning of the funnel 85 to 1.3 meters at the terminal end of the trough 82. As constructed, the funnel 85 feeds logs to an entrance of the chipper 180. Moreover, the vertical sides of the funnel 85 protect system operators from unintentional ejection of logs or chips from the chipper 180.

In a manner similar to the infeed conveyor trough 22, as described above, the trough 82 is affixed to a frame 90. In this illustrated embodiment, the frame 90 includes vertical support members 92, horizontal members 94, and lateral members 96. The frame 90 is constructed such that two horizontal members 94 are positioned parallel below the length of the chipper infeed conveyor 81. One of a pair of vertical support members 92 is affixed perpendicularly to each of the horizontal members 94 at both the entry end and the terminal end of the chipper infeed conveyor system 80. Thereafter, additional pairs of vertical support members 92 are affixed perpendicularly to the horizontal members 94 and are spaced nominally 2.7 meters apart. Finally, lateral members 96 are affixed perpendicularly between the horizontal members 94 beginning at the entry end and concluding at the terminal end and therebetween are spaced nominally 2.7 meters apart. The frame 90 is constructed to support a subframe 91 fixedly mounted to the lateral members 96 of the frame 90.

The subframe 91 is constructed to support the conveyor 81. In this embodiment, a pair of vertical members 911 of the subframe 91 is affixed to each of the lateral members 96 exclusive of the lateral members at the entry and terminal ends and are spaced nominally 1.1 meters apart along the lateral members 96. Thereafter, an upper cross member 912 and a lower cross member 913 are affixed perpendicularly between each of the pairs of vertical members 911 thereby providing a pathway 914 for the return of the conveyor 81. As constructed, the pathway 914 is approximately 0.5 meters high by 0.9 meters wide. A brace 915 affixed to the lower cross member 913 further braces the subframe 91. The members of the frame and subframe 91 are, for example I beams. The frame 90 and subframe 91 are designed and sized to withstand the loading and impact anticipated for the processing system.

The chipper infeed conveyor 81 conveys logs from the log wash conveyor 161 to the log chipper 180. The design capacity of this conveyor is 250 metric tons per hour with a track-chain speed of 51 meters per minute. In this embodiment, the log loading conveyor 81 is a single track assembled of five sections 7358 mm long with one shoe per link. Each shoe is 760 mm wide. As described above, a single track configuration is used to meter the flow of logs into the chipper. A description of the Quad Link track and the track shoe is provided above and is omitted here. In this embodiment, the track-chain conveyor 81 is powered by a 132 Kw motor 87 through a direct coupled reducer 871 to a head sprocket 88 mounted on a head sprocket deck 881. Upon engagement, the head sprocket 88 drives the conveyor 81. The conveyor 81 returns via the pathway 914 and engages a free tail sprocket 89 mounted on a tail sprocket deck 891. The general dimensions of the conveyor structure are approximately 18,200 mm (18.2 meters) long by 4,400 mm (4.4 meters) wide.

The chipper 180 is also of known design or may be a proprietary chipper of the manufacturer, provided the chipper is adapted to receive logs of the size and at a rate anticipated for the processing system as a whole. In this embodiment, wood chips produced by the chipper 180 are transported by a six-strand chain conveyor 182 to a disc screen 184. Thereafter, the wood chips pass through the disc screen 184 and are separated thereby from any debris and bark refuse. The refuse is transported by a scalper belt conveyor 186, then to the belt conveyor 106, and finally to the bark storage 108.

The wood chips pass through the disc screen 184 to a chip conveyor 188 for transport to a rechipping station 190. First, the rechipping station 190 screens fine particulate, or fines, from the wood chips and transports the fines to a fines bin 192 via a screw conveyor 194. The rechipping station performs a secondary sort according to size screening for unacceptably large chips, or overs. Acceptable chips, or accepts, pass through a vibrating conveyor 195 and are transported to chip storage 196 or chip bins 198 via a final belt conveyor 200. The overs are rechipped by rechippers 197 and are recycled back through the rechipping station for sorting. Ultimately, all the processed wood is transported to chip storage 196, to chip bins 198, or to fines bin 192.

While the invention has been described in connection with what is presently considered to be the most practical and preferred embodiment, it is understood that the invention is not limited to the disclosed embodiment, but, on the contrary, is intended to cover various modifications and equivalent arrangements included within the spirit and scope of the appended claims.

What is claimed:

1. A log conveyor comprising:

a frame constructed and arranged to withstand loading and impacts associated with high volume log processing;

a subframe disposed on the frame constructed and arranged to withstand loading and impacts associated with high volume log processing;

a trough disposed on the frame, said trough having inclined sides for containing and guiding logs transported by the conveyor; and a conveyor track having a plurality of links arranged in a closed loop movably disposed on the subframe, each of said plurality of links having a width sufficient to accommodate a breadth of at least one log, at least some of said links having at least one shoe member projecting therefrom thereby defining a beating surface upon which the logs are supported, said conveyor track being constructed and arranged to withstand loading and impacts associated with high volume log processing.

2. A log conveyor according to claim 1, wherein each link of said plurality of links includes one shoe member projecting therefrom and extending across at least a portion of the width of each link.

3. A log conveyor according to claim 1, wherein each link of said plurality of links includes a sealed pin and bushing assembly.

4. A log conveyor according to claim 1, further comprising a split master link disposed between a pair of adjacent links of said plurality of links.

5. A log conveyor according to claim 1, further comprising a tail sprocket disposed on one end of the subframe and positioned to engage the conveyor track, a head sprocket disposed on the other end of the subframe and positioned to engage the conveyor track, and a motor and reducer assembly operatively coupled to one of said head sprocket and said tail sprocket for driving the conveyor track.

6. A log conveyor according to claim 1, wherein the frame and the subframe are each constructed from I beams.

7. A log conveyor according to claim 1, wherein two side by side, parallel conveyor tracks are disposed movably on the subframe.

8. A log conveyor system comprising:

a debarker infeed conveyor configured for placement at an entry end of a debarking drum for conveying logs to the debarking drum;

a debarker outfeed conveyor configured for placement at a terminal end of the debarking drum for conveying logs from the debarking drum;

a log loading conveyor disposed at a terminal end of the debarker outfeed conveyor for conveying logs from the debarker outfeed conveyor and for selectively receiving debarked logs from a remote source; and a chipper infeed conveyor disposed at a terminal end of the log loading conveyor for conveying logs to a chipper, at least-one of said debarker infeed conveyor, debarker outfeed conveyor, log loading conveyor, and chipper infeed conveyor having a track-chain conveyor track having a plurality of links arranged in a closed loop, each of said plurality of links having a width sufficient to accommodate a breadth of at least one log, at least some of said links having at least one shoe member projecting therefrom thereby defining a bearing surface upon which the logs are supported, said track-chain conveyor track being constructed and arranged to withstand loading and impacts associated with high volume log processing.

9. A log conveyor system according to claim 8, wherein the debarker infeed conveyor, the debarker outfeed conveyor, the log loading conveyor, and the chipper infeed conveyor each comprise a track-chain conveyor track.

10. A log conveyor system according to claim 8, wherein each link of said plurality of links includes one shoe member projecting therefrom and extending across at least a portion of the width of each link.

11. A log conveyor system according to claim 8, further comprising a trough substantially circumscribing the debarker infeed conveyor, said trough having sides sufficiently inclined to contain and guide the logs transported by the debarker infeed conveyor.

12. A log conveyor system according to claim 11, wherein the sides are inclined between approximately 15 and 55 degrees.

13. A log conveyor system according to claim 11, wherein the sides are inclined approximately 36 degrees.

14. A log conveyor system according to claim 11, wherein the sides are between about 2 and 5 meters wide.

15. A log conveyor system according to claim 11, wherein the sides are nominally about 3 meters wide.

16. A log conveyor system according to claim 11, wherein the trough further includes an inclined plate disposed at an entry end of the sides and guide plates disposed at a terminal end of the sides.

17. A log conveyor system according to claim 16, wherein the inclined plate is inclined between approximately 30 and 80 degrees and is between about 2 and 3 meters long.

18. A log conveyor system according to claim 16, wherein the inclined plate is inclined approximately 53 degrees and is nominally about 2.25 meters long.

19. A log conveyor system according to claim 16, wherein the inclined sides taper inwardly and downwardly along approximately 6 meters of the terminal end of the sides.

20. A log conveyor system according to claim 19, wherein the guide plates are disposed vertically from the inwardly tapered portions of the inclined sides.

21. A log conveyor system according to claim 9, wherein the debarker infeed conveyor has two, side by side parallel track-chain conveyor tracks.

22. A log conveyor system according to claim 8, further comprising a housing substantially enclosing an entry end of the debarker outfeed conveyor, said housing being configured for placement adjacent the terminal end of the debarking drum.

23. A log conveyor system according to claim 22, wherein the housing encloses a portion of the debarker outfeed conveyor and is approximately 5.8 meters high.

24. A log conveyor system according to claim 8, further comprising a trough partially circumscribing the debarker outfeed conveyor, said trough having sides sufficiently inclined to contain and the guide logs transported by the debarker outfeed conveyor.

25. A log conveyor system according to claim 24, wherein the sides are inclined between approximately 10 and 50 degrees.

26. A log conveyor system according to claim 24, wherein the sides are inclined approximately 27 degrees.

27. A log conveyor system according to claim 24, wherein the sides are between about 1 and 3 meters wide.

28. A log conveyor system according to claim 24, wherein the sides are nominally about 1.6 meters wide.

29. A log conveyor system according to claim 24, wherein the trough further includes vertical sides extending from the inclined sides.

30. A log conveyor system according to claim 24, wherein the trough is further includes an inclined plate disposed at an entry end of the sides.

31. A log conveyor system according to claim 9, wherein the debarker outfeed conveyor has two, side by side parallel track-chain conveyor tracks.

32. A log conveyor system according to claim 8, further comprising a trough partially circumscribing the log loading conveyor, said trough having sides sufficiently inclined to contain and guide the logs transported by the log loading conveyor.

33. A log conveyor system according to claim 32, wherein the sides are inclined between approximately 10 and 50 degrees.

34. A log conveyor system according to claim 32, wherein the sides are inclined approximately 27 degrees.

35. A log conveyor system according to claim 32, wherein the sides are between about 1 and 3 meters wide.

36. A log conveyor system according to claim 32, wherein the sides are nominally about 1.9 meters wide.

37. A log conveyor system according to claim 32, wherein the trough further includes vertical sides extending from the inclined sides.

38. A log conveyor system according to claim 8, further comprising a trough partially circumscribing the chipper infeed conveyor, said trough having sides sufficiently inclined to contain and guide the logs transported by the chipper infeed conveyor.

39. A log conveyor system according to claim 38, wherein the sides are inclined between approximately 10 and 50 degrees.

40. A log conveyor system according to claim 38, wherein the sides are inclined approximately 27 degrees.

41. A log conveyor system according to claim 38, wherein the sides are between about 1 and 3 meters wide.

42. A log conveyor system according to claim 38, wherein the sides are nominally about 1.9 meters wide.

43. A log conveyor system according to claim 38, wherein the trough further includes vertical sides extending from the inclined sides.

44. A log conveyor system according to claim 43, wherein the vertical sides taper inwardly.

45. A log debarking and chipping system comprising:

a debarker infeed conveyor;

a debarking drum disposed at a terminal end of the debarker infeed conveyor for receiving logs from the debarker infeed conveyor and debarking the logs;

a debarker outfeed conveyor disposed at a terminal end of the debarking drum for conveying logs from the debarking drum;

a log loading conveyor disposed at a terminal end of the debarker outfeed conveyor for conveying logs from the debarker outfeed conveyor and for selectively receiving debarked logs from a remote source;

a chipper infeed conveyor disposed at a terminal end of the log loading conveyor for conveying logs from the log loading conveyor; and a chipper disposed at a terminal end of the chipper infeed conveyor for receiving logs from the chipper infeed conveyor and chipping the logs, at least one of said debarker infeed conveyor, debarker outfeed conveyor, log loading conveyor, and chipper infeed conveyor having a track-chain conveyor track having a plurality of links arranged in a closed loop, each of said plurality of links having a width sufficient to accommodate a breadth of at least one log, at least some of said links having at least one shoe member projecting therefrom thereby defining a bearing surface upon which the logs are supported, said track-chain conveyor track being constructed and arranged to withstand loading and impacts associated with high volume log processing.

46. A log debarking and chipping system according to claim 45, further comprising a log washer disposed between the log loading conveyor and the chipper infeed conveyor.

47. A log debarking and chipping system according to claim 45, further comprising means for sorting chips produced by the chipper.

48. A log debarking and chipping system according to claim 45, wherein the debarker infeed conveyor, the debarker outfeed conveyor, the log loading conveyor, and the chipper infeed conveyor each comprise a track-chain conveyor track.

49. A log debarking and chipping system according to claim 45, wherein each link of said plurality of links includes one shoe member projecting therefrom and extending across at least a portion of the width of each link.

* * * * *